US010030618B2

(12) United States Patent
Miki et al.

(10) Patent No.: US 10,030,618 B2
(45) Date of Patent: Jul. 24, 2018

(54) EXHAUST GAS RECIRCULATION VALVE, THAWING SYSTEM OF EXHAUST GAS RECIRCULATION VALVE, AND ENGINE

(71) Applicant: Komatsu Ltd., Minato-ku, Tokyo (JP)

(72) Inventors: Akihiro Miki, Oyama (JP); Hideyuki Seiyama, Oyama (JP); Masashi Karasawa, Oyama (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 0 days.

(21) Appl. No.: 15/026,156

(22) PCT Filed: Sep. 11, 2015

(86) PCT No.: PCT/JP2015/075842
§ 371 (c)(1),
(2) Date: Mar. 30, 2016

(87) PCT Pub. No.: WO2016/013689
PCT Pub. Date: Jan. 28, 2016

(65) Prior Publication Data

US 2017/0074216 A1 Mar. 16, 2017

(51) Int. Cl.
*F02M 26/73* (2016.01)
*F02M 26/72* (2016.01)
*F02M 26/69* (2016.01)

(52) U.S. Cl.
CPC ..... *F02M 26/73* (2016.02); *F02M 26/69* (2016.02); *F02M 26/72* (2016.02)

(58) Field of Classification Search
CPC ..... F02M 26/30; F02M 26/72; F02M 26/73; F02M 26/65
(Continued)

(56) References Cited

U.S. PATENT DOCUMENTS 5,680,880 A * 10/1997 Miyake ..... F16K 31/04 137/338
5,937,835 A * 8/1999 Turner ..... F02M 26/68 123/568.24
(Continued)

FOREIGN PATENT DOCUMENTS

CN 1653259 8/2005
CN 102597478 7/2012
(Continued)

OTHER PUBLICATIONS

Office Action in Japanese Application No. 2015-562989, dated Aug. 23, 2016, 5 pages, with English translation.
(Continued)

*Primary Examiner* — Stephen K Cronin
*Assistant Examiner* — Brian Kirby
(74) *Attorney, Agent, or Firm* — Fish & Richardson P.C.

(57) ABSTRACT

An exhaust recirculation valve includes: a valve housing including an exhaust gas path; a valve element provided to the exhaust gas path and configured to open and close the exhaust gas path; and a stem connected to the valve element and movable in an axial direction, in which the valve housing includes: an inlet from which fluid is supplied from the outside; a recess configured to flow the fluid flowed from the inlet toward the stem; and a throttle in a form of an opening extending from the inlet and oriented toward the stem.

12 Claims, 2 Drawing Sheets

Figure 1:
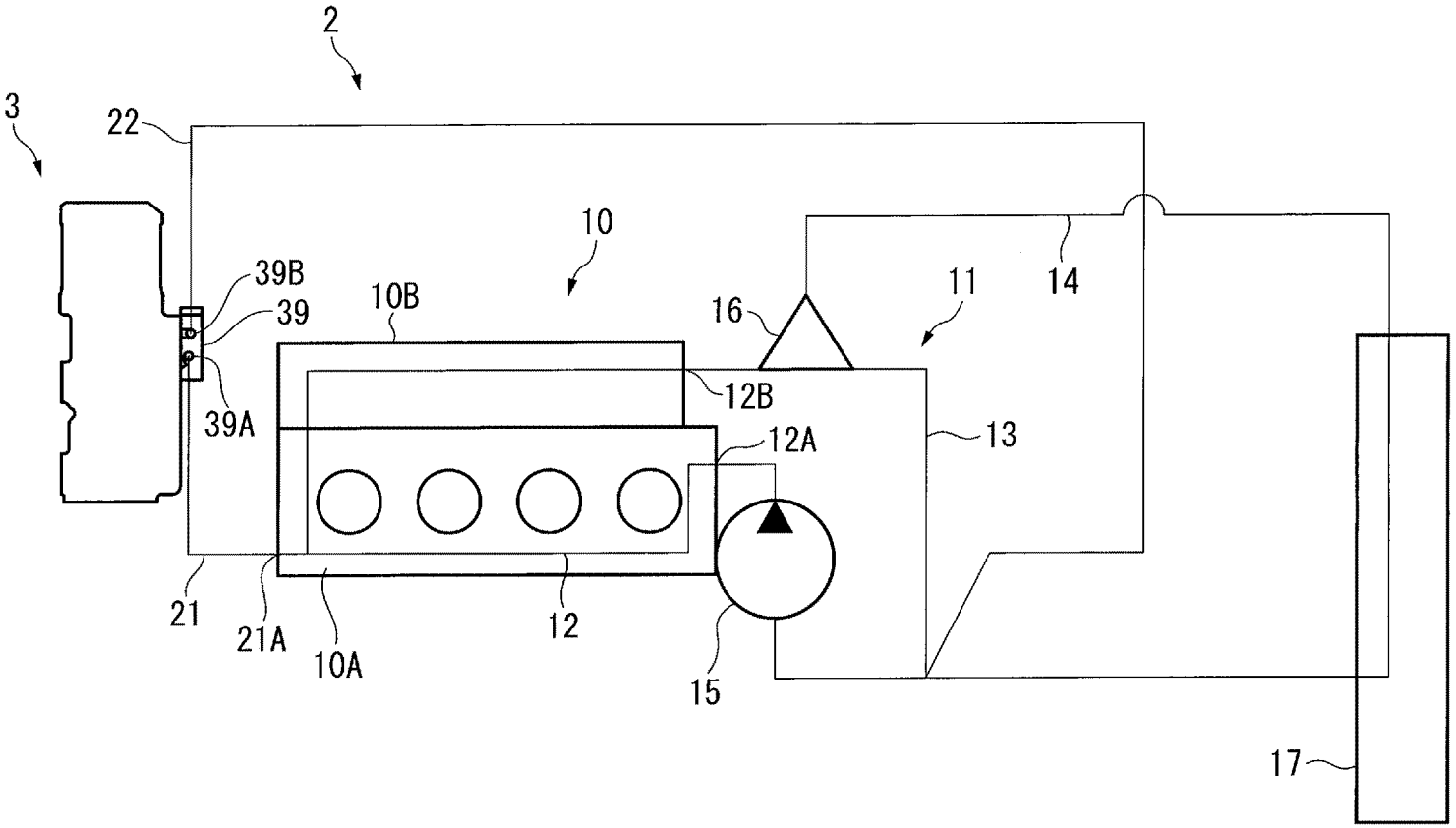

(58) Field of Classification Search
USPC ..... 123/568.11, 568.21, 568.24, 568.26
See application file for complete search history.

(56) References Cited

U.S. PATENT DOCUMENTS 5,957,117 A * 9/1999 Everingham ..... F02M 26/53 123/568.26
5,970,960 A * 10/1999 Azuma ..... F02M 35/10222 123/568.12
6,089,536 A * 7/2000 Watanabe ..... F02D 11/10 123/41.01
6,102,016 A * 8/2000 Sitar ..... F02M 26/67 123/568.23
6,182,646 B1 * 2/2001 Silberstein ..... F02M 26/48 123/568.26
6,182,684 B1 * 2/2001 Frankenberg ..... F02B 47/08 123/568.26
6,237,547 B1 * 5/2001 Ishiyama ..... F02M 35/10131 123/41.31
6,631,707 B1 * 10/2003 Bender ..... F02M 26/73 123/568.11
6,708,675 B2 * 3/2004 Kato ..... F02B 47/08 123/568.12
6,789,532 B2 * 9/2004 Kato ..... F02M 26/22 123/568.12
7,455,056 B2 * 11/2008 Seiyama ..... F01L 3/08 123/188.6
7,895,993 B2 * 3/2011 Weisz ..... F16K 3/0281 123/568.26
8,113,184 B2 * 2/2012 Seiyama ..... F16K 11/0716 123/568.12
9,062,636 B2 * 6/2015 Nishimori ..... F02M 25/0795
2001/0032631 A1 * 10/2001 Cook ..... F02M 26/12 123/568.12
2002/0174858 A1 11/2002 Kato et al.
2004/0099245 A1 5/2004 Kato et al.
2005/0199381 A1 9/2005 Mercz et al.
2009/0078898 A1 * 3/2009 Sasaki ..... F02D 41/0077 251/129.11
2010/0263610 A1 10/2010 Mercz et al.
2012/0167862 A1 7/2012 Nishimori et al.
2012/0313025 A1 * 12/2012 Takai ..... F16K 27/0218 251/313
2013/0206085 A1 8/2013 Adam et al.
2013/0269664 A1 * 10/2013 Park ..... F02M 25/0773 123/568.29

FOREIGN PATENT DOCUMENTS

CN 102947574 2/2013
DE 10344218 4/2005
JP H06-028251 2/1994
JP H08-028251 1/1996
JP 2000002114 A * 1/2000
JP 2005-036672 2/2005
JP 2008-088862 4/2008
JP 2013442300 7/2013
WO WO 2003/006815 1/2003

OTHER PUBLICATIONS

International Search Report and Written Opinion in International Application No. PCT/JP2015/075842, dated Nov. 9, 2015, 14 pages.
Chinese Office Action in Chinese Application No. 2015800018652, dated Sep. 5, 2017, 6 pages (with English translation).
Chinese Office Action in Chinese Application No. 201580001865.2, dated Mar. 27, 2018, 12 pp. (with English translation).
International Preliminary Report on Patentability in International Application No. PCT/JP2015/075842, dated Mar. 13, 2018, 8 pages.

* cited by examiner

EXHAUST GAS RECIRCULATION VALVE, THAWING SYSTEM OF EXHAUST GAS RECIRCULATION VALVE, AND ENGINE

CROSS-REFERENCE TO RELATED APPLICATION

This application is a National Stage Application under 35 U.S.C. § 371 and claims the benefit of International Application No. PCT/JP2015/075842, filed Sep. 11, 2015. The disclosure of the foregoing application is hereby incorporated by reference in its entirety.

TECHNICAL FIELD

The present invention relates to an exhaust gas recirculation valve, a thawing system of the exhaust gas recirculation valve, and an engine.

BACKGROUND ART

There has been typically known exhaust gas recirculation in which a part of exhaust gas discharged from an engine is returned to an intake side of the engine and a combustion temperature is reduced by combusting such an intake gas with less oxygen concentration, thereby reducing NOx to be generated in the combustion.

In such exhaust gas recirculation, a recirculation pipe line communicates an exhaust manifold with an intake manifold in the engine. An exhaust gas recirculation valve is provided in the recirculation pipe line (see, for instance, Patent Literature 1). When the exhaust gas recirculation is performed, the exhaust gas recirculation valve is opened and a part of the exhaust gas is recirculated from the exhaust manifold to the intake manifold.

CITATION LIST

Patent Literature(s)

Patent Literature 1: International Publication No. WO2003/006815

SUMMARY OF THE INVENTION

Problem(s) to be Solved by the Invention

However, for instance, when a typical exhaust gas recirculation valve is used in cold areas and the like, water contained in the exhaust gas becomes frozen between a stem connected to a valve element and a support configured to support the stem, so that the stem occasionally adheres on the support in a closed state of the exhaust gas recirculation valve. In such a state, it is necessary to wait for a frozen part to be thawed by heat from the sufficiently warmed engine after the engine is started and it takes time to be ready for performing the exhaust gas recirculation.

When the stem slightly adheres on the support, the valve element is openable by scraping the frozen part by a wiping operation. However, an ice piece is occasionally interposed between the stem and the support to again cause the stem to adhere on the support in an open state of the valve element.

An object of the invention is to provide an exhaust gas recirculation valve capable of reliably reducing a startup time required for performing exhaust gas recirculation, a thawing system of the exhaust gas recirculation valve, and an engine.

Means for Solving the Problem(s)

According to an aspect of the invention, an exhaust gas recirculation valve includes: a valve housing having an exhaust gas path; a valve element provided in the exhaust gas path and configured to open and close the exhaust gas path; and a stem connected to the valve element and movable in an axial direction, in which the valve housing includes: an inlet from which fluid is supplied from the outside; a recess configured to flow the fluid flowed from the inlet toward the stem; and a throttle in a form of an opening extending from the inlet and oriented toward the stem.

Since the stem is often provided in a farther central position of the exhaust gas recirculation valve, in the exemplary embodiment, the recess is provided to the valve housing and configured to reliably flow a thawing fluid toward the stem. However, since the fluid is likely to stagnate in such a recess, the throttle in a form of an opening oriented toward the stem is provided. The inflow fluid is vigorously injected through the throttle to the recess, whereby the fluid can be reliably circulated in the recess to quickly warm up and accelerate thawing near the stem.

In the exhaust gas recirculation valve according to the above aspect of the invention, it is preferable that the valve housing includes an outlet from which the fluid is flowed, and the recess is configured to flow the fluid from the inlet to the outlet.

A thawing system of an exhaust gas recirculation valve according to another aspect of the invention includes: the above-described exhaust gas recirculation valve; a supply flow path branched from a cooling water circuit of an engine and configured to supply the fluid in a form of an engine cooling water to the exhaust gas recirculation valve; and a return flow path configured to return the engine cooling water from the exhaust gas recirculation valve to a return side of the cooling water circuit of the engine.

In the thawing system of an exhaust recirculation valve according to the above aspect of the invention, it is preferable that the cooling water circuit of the engine includes: a first cooling water circuit including a pump on a side where the engine cooling water is flowed to the engine; and a second cooling water circuit configured to branch the engine cooling water via a thermostat on the side of the engine from which the engine cooling water is flowed and return the engine cooling water to the pump through a radiator, the supply flow path is branched from the cooling water circuit of the engine at a position between the thermostat and a side of the pump from which the engine cooling water is flowed, and the return flow path is configured to return the engine cooling water to the cooling water circuit of the engine at a position between a side of the radiator from which the engine cooling water is flowed and a side of the pump into which the engine cooling water is flowed.

According to still another aspect of the invention, an engine is installed with the above-described thawing system of the exhaust gas recirculation valve.

BRIEF DESCRIPTION OF DRAWING(S)

FIG. 1 schematically shows an engine and a thawing system of an exhaust gas recirculation valve installed in the engine in an exemplary embodiment of the invention.

Figure 2:
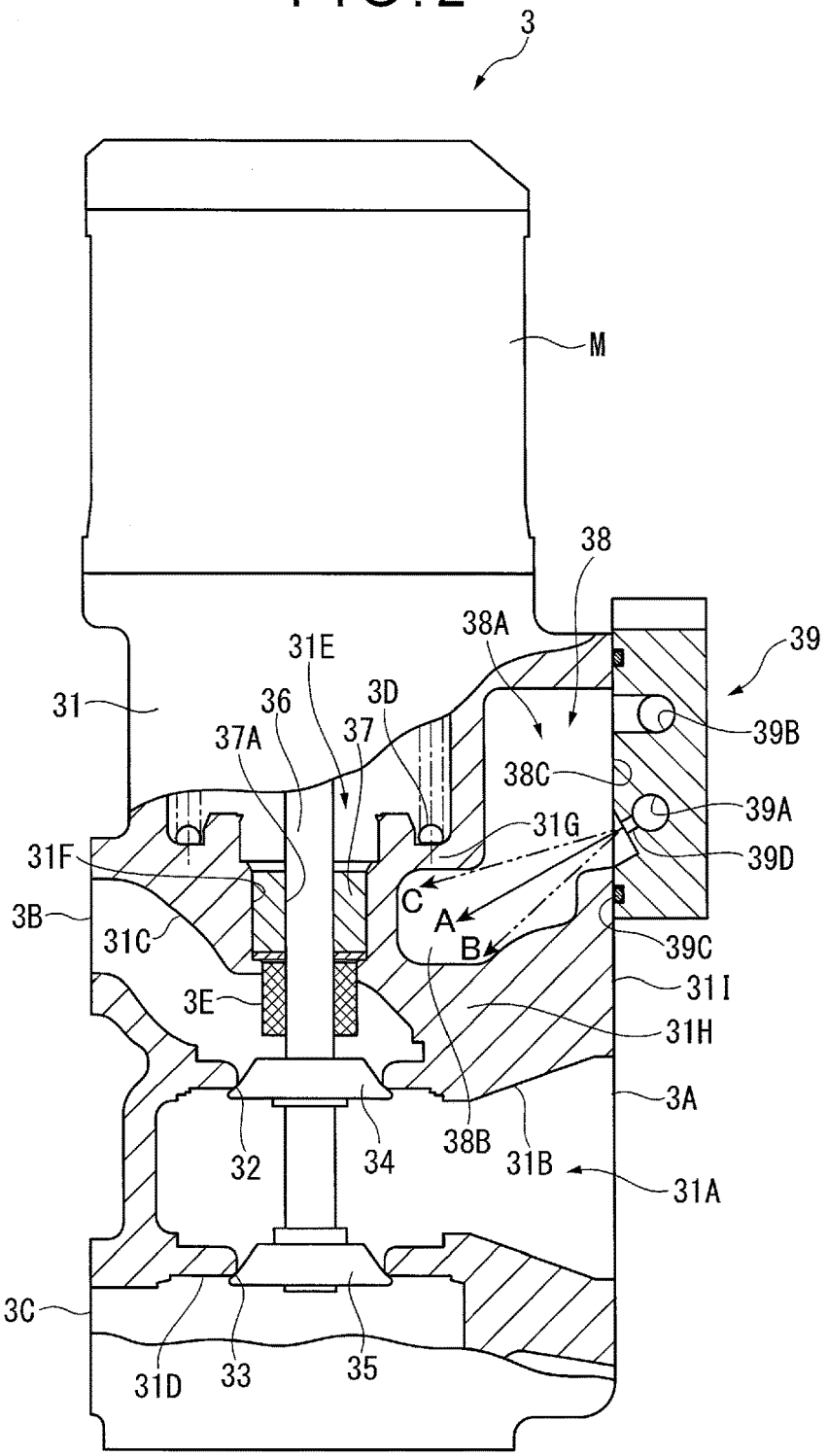

FIG. 2 shows a cross-sectional view of the exhaust gas recirculation valve.

DESCRIPTION OF EMBODIMENT(S)

Description of Outline of Thawing System

Exemplary embodiment(s) of the invention will be described below with reference to the attached drawings.

FIG. 1 schematically shows an engine 10 and a thawing system 1 of an exhaust gas recirculation valve 3 installed in the engine 10 in an exemplary embodiment.

The thawing system 1 is a system for quickly thawing the exhaust gas recirculation valve 3, which is used for an exhaust gas recirculation system (not shown), in a frozen state to reduce a startup time required for performing exhaust gas recirculation.

In the exemplary embodiment, the engine 10 is supposed to be installed in a construction machine usable in cold areas and the like. However, the installation of the engine 10 is not limited thereto In the construction machine operated in the cold areas, the exhaust gas recirculation valve 3 becomes frozen when the engine 10 is kept stopped for a predetermined time after the exhaust gas recirculation is performed in the engine 10. In other words, exhaust gas passes through the exhaust gas recirculation valve 3 during the exhaust gas recirculation, but, after the engine 10 is stopped, water contained in the exhaust gas remaining in the exhaust gas recirculation valve 3 is cooled to be frozen because an outer temperature is decreased.

As shown in FIG. 1, the thawing system 1 includes: the valve thawing water circuit 2 that is branched from an engine cooling water circuit 11 (a cooling water circuit) configured to cool the engine 10 using an engine cooling water and again joins the engine cooling water circuit 11; and the exhaust gas recirculation valve 3 configured to flow the engine cooling water in and out from the valve thawing water circuit 2.

The engine cooling water circuit 11 includes: an engine-side water jacket 12 provided inside the engine 10; a first cooling water circuit 13 provided outside the engine 10; and a second cooling water circuit 14 provided outside the engine 10.

The engine water jacket 12 is in a form of an inner space by which a cylinder block 10A intercommunicates with a cylinder head 10B and through which the engine cooling water passes. The cylinder block 10A includes an engine-side inlet 12A through which the engine cooling water is flowed from the first cooling water circuit 13 to the engine water jacket 12. The cylinder head 10B includes a first engine-side outlet 12B through which the engine cooling water is flowed from the engine water jacket 12 to the first cooling water circuit 13.

A water pump 15 serving as a pump for circulating the engine cooling water is provided in the first cooling water circuit 13 near a side of the engine 10 into which the engine cooling water is flowed. The water pump 15 is driven by power outputted from the engine 10.

The second cooling water circuit 14 is branched via a thermostat 16 from the first cooling water circuit 13 near a side of the engine 10 from which the engine cooling water is flowed and is configured to return the engine cooling water to the water pump 15 through a radiator 17.

It should be noted that a part of the engine cooling water is used as a thawing water in the thawing system as described below.

Description of Valve Thawing Water Circuit of Thawing System

The valve thawing water circuit 2 includes: a supply flow path 21 that is branched from the engine water jacket 12 and configured to supply a part of the engine cooling water inside the engine water jacket 12 to the exhaust gas recirculation valve 3 as a thawing water (fluid); and a return flow path 22 configured to return the thawing water from the exhaust gas recirculation valve 3 to a joint of the first and second cooling water circuits 13 and 14 on a return side of the engine cooling water circuit 11, specifically, on an upstream side of the water pump 15. The cylinder block 10A includes a second engine-side outlet 21A configured to flow out the thawing water from the engine water jacket 12 to the supply flow path 21.

Description of Exhaust Gas Recirculation Valve

FIG. 2 shows a cross-sectional view of the exhaust gas recirculation valve 3.

As shown in FIG. 2, the exhaust gas recirculation valve 3 includes: a valve housing 31 including an exhaust gas path 31A inside; a first valve seat 32 and a second valve seat 33 (vertically shown in the drawing) that are provided in the exhaust gas path 31A; a first valve element 34 and a second valve element 35 (vertically shown in the drawing) configured to be respectively moved on and off the first valve seat 32 and the second valve seat 33 to open and close the exhaust gas path 31A; and a stem 36 connected to the first valve element 34 and the second valve element 35 (valve element) and movable in an axial direction.

The valve housing 31 includes a cast main body including: a bush 37 supporting the stem 36 inside the valve housing 31; and a valve-side water jacket 38 (recess) configured to flow the thawing water therethrough. The valve housing 31 further includes a closing block 39 including: a valve-side inlet 39A (inlet) configured to flow the fluid supplied from the outside into the valve-side water jacket 38; a valve-side outlet 39B (outlet) configured to flow out the fluid from the valve-side water jacket 38; a throttle 39D in a form of an opening extending from the valve-side inlet 39A and oriented toward the stem 36. The valve-side water jacket 38 and the closing block 39 will be described in detail later.

The exhaust gas path 31A inside the valve housing 31 includes: an inflow path 31B to which exhaust gas is flowed from the exhaust gas inlet 3A on the right side in the drawing; a first outflow path 31C having a first exhaust gas outlet 3B configured to discharge the exhaust gas; and a second outflow path 31D having a second exhaust gas outlet 3C configured to discharge the exhaust gas (the first and second exhaust gas outlets 3B and 3C being vertically shown on the left side in the drawing).

However, a single outflow path is enough. A plurality of outflow paths as provided in the exemplary embodiment are not necessarily required.

The first valve seat 32 is provided as a boundary between the inflow path 31B and the first outflow path 31C. The first valve element 34 is moved on and off the first valve seat 32.

The second valve seat 33 is provided as a boundary between the inflow path 31B and the second outflow path 31D. The second valve element 35 is moved on and off the second valve seat 33.

The first and second valve elements 34 and 35 are shaped in a poppet and are driven synchronously with motion of the stem 36.

When a single outflow path is provided, a single one of each of the valve element and the valve seat is sufficient. A plurality of each of those are not necessarily required.

The stem 36 is inserted through a through hole 31F provided between the first outflow path 31C and a spring chamber 31E thereon in the valve housing 31. A flange (not specifically shown) configured to hold a coil spring 3D between the flange and a seat surface 31G inside the valve housing 31 is provided at an upper portion of the stem 36. The coil spring 3D biases the first and second valve elements 34 and 35 via the stem 36 to a closing position.

The valve housing 31 is attached with an electric linear motion motor M. When an end of the stem 36 is pressed by an end of a rod projecting from the linear motion motor M, the first and second valve elements 34 and 35 can be displaced into an open position against a spring force of the coil spring 3D.

The bush 37 is shaped in a cylinder having an insert hole 37A at the center. The bush 37 is held in the through hole 31F with the stem 36 received in the insert hole 37A to support the stem 36 such that the stem 36 is slidable. At a low outer temperature, the stem 36 occasionally adheres on the bush 37. This is because water in the exhaust gas remaining on a surface of the stem 36 and around the insert hole 37A of the bush 37 becomes frozen.

A cylindrical scraper 3E is also provided in the through hole 31F, in which the cylindrical scraper 3E receives the stem 36 such that the stem 36 is slidable. The scraper 3E is a member configured to scrape carbons and the like adhering on the surface of the stem 36 in conjunction with the sliding motion of the stem 36.

Description of Valve-Side Water Jacket

As shown in FIG. 2, the valve-side water jacket 38 is defined by a thick portion 31H on an upper side (in the figure) of the inflow path 31B in the valve housing 31. Since the thick portion 31H is provided between the valve-side water jacket 38 and the inflow path 31B, a temperature of the thawing water flowing in the valve-side water jacket 38 does not influence the exhaust gas flowing in the inflow path 31B and having a temperature higher than that of the thawing water, so that the thawing water does not function as a cooling water of the exhaust gas.

The valve-side water jacket 38 is configured to flow the thawing water from the valve-side inlet 39A to the valve-side outlet 39B and includes: a first recess 38A near the closing block 39; a second recess 38B near the bush 37; and an opening 38C oriented in the same direction as that of the exhaust gas inlet 3A. The first recess 38A is in communication with the valve-side inlet 39A and the valve-side outlet 39B through the opening 38C.

The first recess 38A is defined as a part near the opening 38C in the valve-side water jacket 38. The first recess 38A provides the shortest flow path connecting the valve-side inlet 39A with the valve-side outlet 39B in the closing block 39 and has a substantially vertically long rectangular cross section in the drawing.

The second recess 38B is defined as an extension from the first recess 38A toward the farthest position at the center of the valve housing 31 and has a substantially horizontally long rectangular cross section in the drawing. The first recess 38A provides the shortest flow path through which the thawing water is flowed between the valve-side inlet 39A and the valve-side outlet 39B, whereas the second recess 38B is provided at a position out of the above flow path.

Accordingly, the thawing water flowed in the second recess 38B is likely to stagnate, so that the cooled thawing water accumulates and cannot sufficiently exhibit the thawing function. For this reason, the later-described throttle 39D is provided in the exemplary embodiment. Provision of the throttle 39D promotes thawing of the frozen part between the bush 37 and the stem 36 supported by the bush 37.

Description of Closing Block

The closing block 39 is provided by a machined block member of a predetermined thickness including a valve-side inlet 39A and a valve-side outlet 39B. The closing block 39 is attached to a flat attachment surface 311 of the main body of the valve housing 31 at a position where the closing block 39 closes the opening 38C of the valve-side water jacket 38. An annular seal member 39C is interposed between the attachment surface 311 and the closing block 39.

The attachment surface 311 of the valve housing 31 is a machined surface by a finishing process to have a predetermined surface roughness. A recirculation pipe line (not shown) through which the exhaust gas is introduced to the exhaust gas inlet 3A of the exhaust gas recirculation valve 3 is also attached to the attachment surface 311.

The closing block 39 includes the throttle 39D in a form of the opening communicating with the valve-side inlet 39A and oriented toward the stem 36 through the valve-side water jacket 38. Specifically, the throttle 39D is oriented, as shown by a solid line arrow A in the drawing, to inject the thawing water toward the center of the second recess 38B.

With this arrangement, the thawing water is vigorously injected toward the second recess 38B to directly stir the thawing water tending to be stagnant in the second recess 38B and promotes flowing of the thawing water. Consequently, the adhesion part between the frozen stem 36 and bush 37 is favorably warmed up by the temperature of thawing water in a continuous inflow.

The direction of the throttle 39D is not limited to the direction described above, but may be a direction of injecting the fluid along an inner wall surface of the second recess 38B, for instance, as shown by two-dot chain line arrows B and C in the drawing.

Description of Flow of Engine Cooling Water and Thawing Water

For instance, when the engine 10 is kept stopped overnight in cold areas and the like, water contained in the exhaust gas recirculated by the exhaust gas recirculation becomes frozen by a decrease in the outer air temperature, so that the stem 36 adheres on the bush 37. In this condition, when the engine 10 is restarted next morning, the water pump 15 is driven to circulate the engine cooling water in the first cooling water circuit 13 of the engine cooling water circuit 11 and circulate the engine cooling water (the thawing water) branched from the engine water jacket 12 in the valve thawing water circuit 2.

At this time, since the engine 10 reaches a high temperature by an engine combustion temperature immediately after the engine 10 is started, a temperature of the engine cooling water is not so increased as to require heat exchange in the radiator 17, but quickly reaches a temperature enough for generating hot air for an air conditioner. Similarly, a temperature of the engine cooling water as the thawing water also quickly reaches a temperature hot enough to thaw the frozen part between the stem 36 and the bush 37. Since the engine cooling water does not reach an extremely high temperature, the thermostat 16 remains closed. Accordingly, the engine cooling water is not circulated into the second cooling water circuit 14 including the radiator 17, so that the engine cooling water cooled by the radiator 17 and the thawing water are not mixed in the joint. Consequently, the thawing water is kept at a temperature suitable for thawing the frozen part, so that the frozen part is quickly thawed to allow the exhaust gas recirculation to be started in a short time.

When the engine 10 is kept working after the frozen part is thawed, since the temperature of the engine cooling water reaches a sufficiently high temperature, the thermostat 16 is opened, whereby the engine cooling water is circulated in the second cooling water circuit 14, so that the engine cooling water is cooled by the radiator 17. On the other hand, although the thawing water also reaches a high temperature, the heated water is merged with the engine cooling water cooled by the radiator 17, so that the thawing water reaches substantially the same temperature as that of the engine cooling water and is kept at a predetermined temperature. When the exhaust gas recirculation is performed, a temperature of the exhaust gas passing through the exhaust gas recirculation valve 3 is significantly higher than the temperature of the thawing water. Accordingly, the thawing water functions as a valve cooling water for cooling the stem 36 and the bush 37 heated by the exhaust gas.

Since the valve-side water jacket 38 is separated from the inflow path 31B by the thick portion 31H as described above, the exhaust gas flowing in the inflow path 31B is not cooled by the thawing water in the exhaust gas recirculation valve 3.

According to the exemplary embodiment, although the thawing water is likely to stagnate in the second recess 38B of the valve-side water jacket 38 provided in the exhaust gas recirculation valve 3 as compared with in the first recess 38A near the valve-side inlet 39A and near valve-side outlet 39B of the thawing water, since the throttle 39D opened toward the second recess 38B is provided to the valve-side inlet 39A, the inflow thawing water can be vigorously injected to the second recess 38B. With this arrangement, since the thawing water is reliably circulated even in the second recess 38B, the adhesion part between the frozen stem 36 and bush 37 is quickly warmed up to accelerate thawing of the adhesion part, so that a startup time required for performing exhaust gas recirculation is reliably reducible.

It should be understood that the scope of the invention is not limited to the above-described exemplary embodiment (s) but includes modifications and improvements as long as the modifications and improvements are compatible with the invention.

In the above exemplary embodiment, the valve thawing water circuit 2 is configured to branch the thawing water from the engine water jacket 12 and return the thawing water to the joint between the first and second cooling water circuits 13 and 14 of the engine cooling water circuit 11. However, the arrangement of the valve thawing water circuit 2 is not limited thereto.

Specifically, it is only required that a position where the valve thawing water circuit 2 is branched from the engine cooling water circuit 11 is located between the thermostat 16 and a side of the water pump 15 from which the engine cooling water is flowed. For instance, the valve thawing water circuit 2 may be branched from an upstream side of the thermostat 16 in the first cooling water circuit 13 provided to an exterior of the engine 10.

On the other hand, it is only required that the valve thawing water circuit 2 is returned to the engine cooling water circuit 11 at a position between a side of the radiator 17 from which the engine cooling water is flowed and a side of the water pump 15 into which the engine cooling water is flowed. However, in consideration of balance between a flow rate of the thawing water flowed in the valve thawing water circuit 2 and a flow rate of the engine cooling water flowed in the engine cooling water circuit 11, the return position is preferably determined as described in the above exemplary embodiment or located closer to the water pump 15 in the first cooling water circuit 13.

The invention is applicable to an exhaust gas recirculation valve of an engine installed in a construction machine, a working vehicle such as an agricultural vehicle and a delivery vehicle, stationary power generator, or the like.

The invention claimed is:

1. An exhaust gas recirculation valve comprising:

a valve housing comprising an exhaust gas path;

a valve element provided in the exhaust gas path and configured to open and close the exhaust gas path;

a stem connected to the valve element and movable in an axial direction, and a bush that supports the stem in a slidable manner, wherein the valve housing comprises:

an inlet branched from a cooling water circuit of an engine and configured to supply an engine cooling water;

an outlet from which the engine cooling water is flowed;

a recess configured to flow the engine cooling water flowed from the inlet to pass near the stem to the outlet; and a throttle opened to extend from the inlet and oriented toward the stem and configured to inject the engine cooling water into the recess to stir the engine cooling water in the recess, the throttle being integrated with the valve housing, wherein the recess comprises:

an opening oriented in the same direction as an exhaust gas inlet;

a first recess provided near the opening, the first recess being in communication with the inlet and the outlet through the opening to define a first flow path connecting the inlet and the outlet; and a second recess extending from the first recess toward the stem and in an opposite direction from the inlet and the outlet, the second recess being closed by the valve housing and provided at a position out of the first flow path, and wherein the second recess is spaced apart at a predetermined distance through a thick portion of the valve housing from an inflow path of the exhaust gas path from which the exhaust gas is flowed and is positioned near the bush that supports the stem through a thin portion of the valve housing, the second recess being located closer to the stem relative to the inflow path.

2. A thawing system of an exhaust gas recirculation valve, comprising:

the exhaust gas recirculation valve according to claim 1;

a supply flow path configured to supply the engine cooling water to the exhaust gas recirculation valve; and a return flow path configured to return the engine cooling water from the exhaust gas recirculation valve to a return side of the cooling water circuit of the engine.

3. The thawing system of the exhaust gas recirculation valve according to claim 2, wherein the cooling water circuit of the engine comprises: a first cooling water circuit comprising a pump on a side where the engine cooling water is flowed to the engine; and a second cooling water circuit configured to branch the engine cooling water via a thermostat on the side of the engine from which the engine cooling water is flowed and return the engine cooling water to the pump through a radiator, the supply flow path is branched from the cooling water circuit of the engine at a position between the thermostat and a side of the pump from which the engine cooling water is flowed, and the return flow path is configured to return the engine cooling water to the cooling water circuit of the engine at a position between a side of the radiator from which the engine cooling water is flowed and a side of the pump into which the engine cooling water is flowed.

4. An engine installed with the thawing system of the exhaust gas recirculation valve according to claim 2.

5. The exhaust gas recirculation valve according to claim 1, wherein the throttle is configured to inject the engine cooling water toward a center of the second recess.

6. The exhaust gas recirculation valve according to claim 1, wherein the second recess is integrally formed within the valve housing.

7. The exhaust gas recirculation valve according to claim 6, wherein the second recess is positioned between the first recess and the bush that supports the stem.

8. The exhaust gas recirculation valve according to claim 1, wherein at least a portion of the second recess is defined by the thick portion of the valve housing and the thin portion of the valve housing, the thin and thick portions of the valve housing being integrally formed as a single piece.

9. The exhaust gas recirculation valve according to claim 1, wherein the second recess extends downward from the first recess.

10. The exhaust gas recirculation valve according to claim 1, wherein at least a portion of the second recess is positioned vertically below the first recess.

11. The exhaust gas recirculation valve according to claim 1, wherein the second recess is positioned at a vertically lowermost portion of the recess.

12. The exhaust gas recirculation valve according to claim 1, wherein the second recess is configured to hold the engine cooling water.

* * * * *